United States Patent [19]

Felter

[11] 4,086,028

[45] Apr. 25, 1978

[54] TURBINE VENTILATORS AND METHOD OF MANUFACTURE

[76] Inventor: John V. Felter, P.O. Box 7464, Houston, Tex. 77008

[21] Appl. No.: 748,418

[22] Filed: Dec. 8, 1976

[51] Int. Cl.[2] ..... F03D 3/06

[52] U.S. Cl. ..... 416/227 A; 416/187; 98/72

[58] Field of Search ..... 98/72, 75; 416/227 A, 416/178, 187

[56] References Cited

U.S. PATENT DOCUMENTS

| | | | |
|---|---|---|---|
| 2,272,695 | 2/1942 | Evans | 416/187 |
| 3,239,920 | 3/1966 | Laing | 29/156.8 |
| 3,267,833 | 8/1966 | Artis et al. | 416/197 A X |
| 3,737,966 | 6/1973 | Ranz | 29/156.8 CF |
| 3,739,708 | 6/1973 | Felter | 98/72 |
| 3,844,682 | 10/1974 | Morris | 416/178 |
| 3,854,844 | 12/1974 | Ranz | 416/184 |
| 3,893,383 | 7/1975 | Jones | 98/72 |

FOREIGN PATENT DOCUMENTS

| | | | |
|---|---|---|---|
| 159,724 | 3/1921 | United Kingdom | 98/72 |

*Primary Examiner*—Everette A. Powell, Jr.
*Attorney, Agent, or Firm*—Carl B. Fox, Jr.

[57] ABSTRACT

Rotary turbine ventilators, wherein the vanes are connected to the base ring of the rotary element by a crimping or swaging operation instead of by welding or riveting. The method of manufacturing the ventilators is particularly adapted to the manufacture of aluminum ventilators because of the saving of labor and cost which results when aluminum ventilators are made thereby, although the method may be used to manufacture ventilators of other materials.

3 Claims, 5 Drawing Figures

16
17
16a
18
18
15
15
14
11
11

TURBINE VENTILATORS AND METHOD OF MANUFACTURE

BACKGROUND OF THE INVENTION

The majority of rotary turbine ventilators are made of galvanized iron. Some rotary turbine ventilators are made of aluminum and plastics. In the manufacture of ventilators made of galvanized iron, the vanes of the rotary element are usually affixed to the base ring of the rotary element by spot welding or by riveting. Spot welding of aluminum is difficult and expensive. Because of the low resistance of aluminum to electric current, the welding current flow is high. The welding current can be reduced by reducing the pressure between the parts to be welded together, but this is difficult to control and even so the welding current is higher than with galvanized iron. Furthermore, the welded together aluminum parts must be held together to allow time for the welds to fuse, which slows production and is expensive. Riveting of aluminum parts together, particularly thin parts as are used in manufacture of rotary turbine ventilators, is not particularly practical because of the softness of aluminum.

SUMMARY OF THE INVENTION

According to the invention, ventilators are provided wherein the lower ends of the vanes are connected to the base ring of the rotary elements by crimping or swaging. The crimping or swagged connections are particularly suitable for ventilators manufactured of aluminum, because of the savings in cost and time of manufacture, as discussed above. The connections are stronger than riveted connections for aluminum ventilators. While welded connections would be structurally satisfactory, they are both difficult and expensive. The invention avoids the necessity of use of valuable metal, copper, for welding tips, such welding tips being fairly rapidly used up and requiring replacement at frequent intervals, because of the high welding currents involved with the welding of aluminum. The invention permits the use of vanes which are self-locating, so that peripheral markings ae not necessary to properly locate the bottoms of the vanes around the base ring, and this also permits the use of less skilled and lower paid labor in manufacture of the ventilators. This is accomplished by making the lower ends of the vanes side by side in touching relation, so that the subsequent vanes are located by simply placing them against the preceeding vanes.

A principal object of the invention is to provide rotary turbine ventilators wherein the lower ends of the vanes are connected to the base ring of the rotary assembly by crimped or swaged connections. Another principal object of the invention is to provide methods for connecting the vanes of a rotary ventilator to the base ring of the rotary element or assembly by crimping or swaging. A further object of the invention is to provide such ventilators and methods which are susceptible to rapid and economical manufacture. Still another object of the invention is to provide such ventilators and methods wherein the lower ends of the vanes are self-locatable with respect to the periphery of the base ring of the rotary structure. Another object of the invention is to provide such ventilators which are safe and reliable, and which can be made by use of relatively unskilled labor.

Other objects and advantages of the ventilators and methods according to the invention will appear from the following detailed descriptions of preferred embodiments thereof, reference during the descriptions being made to the accompanying drawings.

BRIEF DESCRIPTIONS OF THE DRAWINGS

DESCRIPTIONS OF THE PREFERRED EMBODIMENTS

Figure 1:
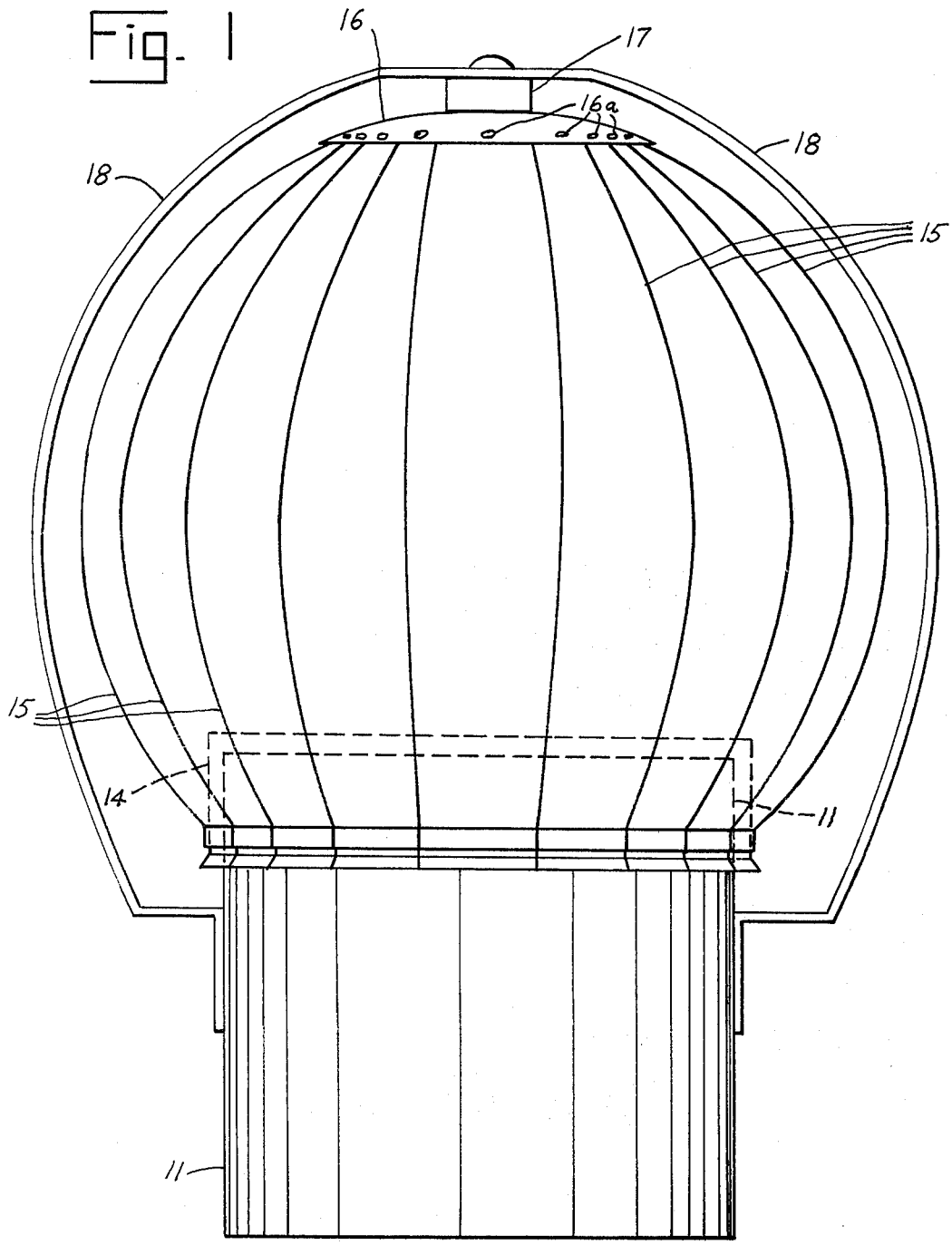
FIG. 1 is side elevation of a preferred form of apparatus according to the invention, shown schematically in part.

Referring to the drawings in detail, and first to FIG. 1, the invention pertains to rotary turbine ventilators of the type of ventilator 10, and to methods for manufacturing such ventilators. The ventilator 10 has a cylindrical support sleeve 11 adapted to be connected to the upper end of a roof jack (not shown), or the like, mounted around an opening through a roof. The rotary assembly or element of the ventilator includes a base ring 14, plural vanes 15, crown connector 16, upper bearing 17, and plural bearing supports, called wind braces, 18. The rotary assembly rotates in response to the wind blowing thereagainst and in response to air moving upward through the ventilator as a result of convection, and the rotary assembly rotation causes air to be drawn upwardly through the ventilator and out between the vanes to ventilate the area beneath the roof. Under most circumstances, the use of a rotary turbine ventilator will result in considerably more upward air flow from beneath the roof than would result from convection alone. Since rotary turbine ventilators are widely known and used, further description of the ventilator apart from the particular features provided according to the invention is not believed necessary.

Figure 2:
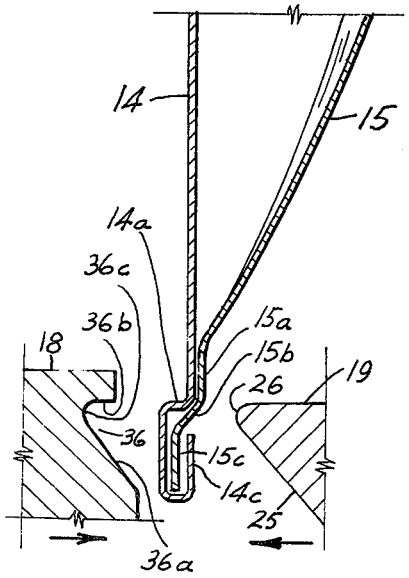
FIGS. 2–4 are vertical cross sections showing the steps of making the swaged connections at the lower ends of the vanes.
Figure 3:
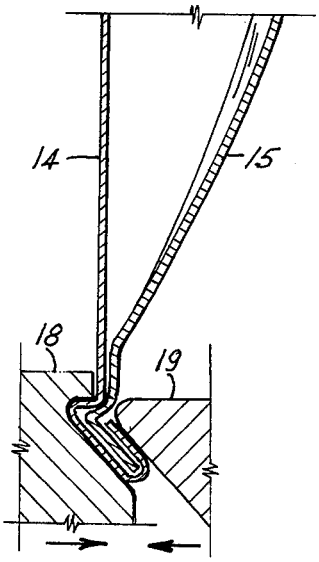
Figure 4:
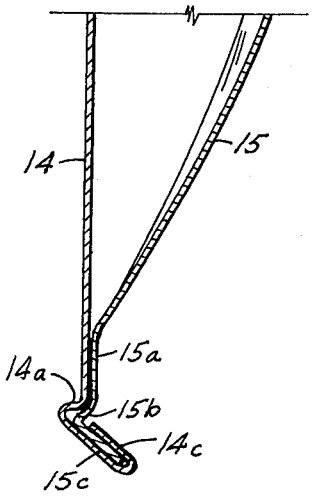

Referring now also to FIGS. 2–4 of the drawings, the lower ends of the vanes 15 are vertical at **15*a* and are inwardly bent at 15*b* to vertical lower end portions 15*c*. The lower edge of base ring 14 of the rotary vane assembly is upset inwardly at 14*a* and has outwardly and upwardly formed edge 14*c*. Vane ends 15*c* are inserted behind ring edge 14*c* as shown in FIG. 2, and then crimped and swaged together by dies 18, 19 as to form shown in FIG. 3 to form a tight and firm connection as shown in FIG. 4**.

The crimping or swaging is preferably accomplished by use of rotary dies. The external die 19 is flared conically at 25. The periphery of the die is rounded at its edge 26. Die 18 has a groove therearound indicated by reference numeral 36 which has angular side **36*a* corresponding to the angle of conically flared end 25 of die 19 and has side 36*b* perpendicular to ring 14. The apex 36*c* of groove 36 is rounded as shown corresponding to the curvature of rounded periphery 26 of die 19**.

Application under pressure of the rotary dies 18, 19 to the loose connection between the lower vane ends and the upper edge of ring 14 as shown in FIGS. 2–3 causes the connection to be crimped or swaged to the form shown in FIG. 4, and thereby tightened to form a permanent rigid connection. The dies are supported by rotary shafts, not shown, and are connected to appropriate drive means for rotating the dies, also not shown.

The ring 14 is held, usually by hand, between dies 18, 19, and the lower vane ends are positioned loosely behind ring edge 14*c* as shown in FIG. 2, one by one, and rolled between the dies to be crimped in place. The subsequent vane end is positioned before being reached by the dies and it too is crimped or swaged as described.

The method is commenced by first positioning one vane end in place and then rotating the dies to commence crimping it to the ring edge. Before the first vane is completely crimped, the next vane end is positioned thereagainst in engagement behind bent end 14*c* of the ring, and the dies are again rotated to complete crimping at the first vane end and to commence crimping at the next vane end. Subsequent vane ends are connected one after another in the same manner until the vane ends are connected completely around the base ring 14. In order that the crimping or swaging may be accomplished in the described manner, the dies are preferably operated by depression of a floor switch by the foot of the operator, which is not shown but the structure and function of which will be readily apparent to those skilled in the art.

The lower vane ends are of a width that the required number of vanes will fit around the base ring edge, flushly side by side to completely but fairly loosely fill the groove formed by bent end 14*c* of the ring 14. Thus, all that the operator need do is successively place each vane end into engagement with the ring, and then depress the floor switch or other suitable operating device controlling rotation of the dies to fix that vane end in place. This is done completely around the ring until the lower ends of all of the vanes have been swaged in place. Usually and preferably, the upper ends of the vanes will previously have been connected to the crown plate 16, so that the vanes are properly spaced at their upper ends. The connection of each vane to the crown plate 16 is usually and preferably made by a single rivet 16*a*, so that the vanes are pivotally movable for placement into engagement with the base ring. After all of the lower vane ends have been connected to the base ring, the rotary assembly is rigid and strong and completely suitable for its intended use.

The shapes of dies 18, 19 result in an outward angular upset formed in the ring edge and lower vane end as is best shown in FIG. 4. This angular upsetting results in swaged connections which cannot come apart and which cannot readily be disconnected. Stress between the connected parts in any direction will not tend to cause them to be separated, and the ventilators made according to this invention are strong and have a long service life.

Referring again particularly to FIGS. 2–3, the dies 18, 19 are pressured one toward the other, so that the swaged connection formed is completely tight. The dies are positioned as shown in FIG. 2 and are brought together as in FIG. 3 to form a tight connection as the dies are rolled under force to form the swage connection. The entire connection is angularly upset as shown by the angularity of the die surfaces.

Figure 5:
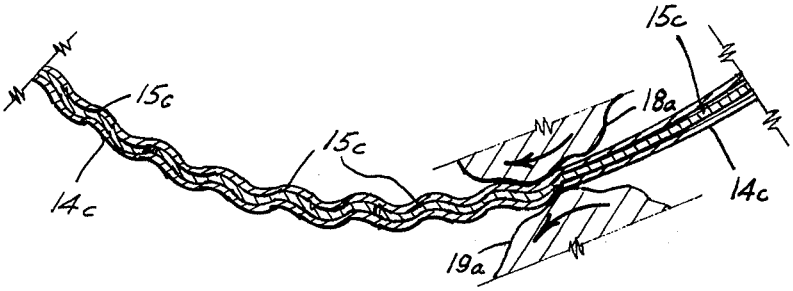
FIG. 5 is a horizontal cross section showing a modified form of swaged connection.

Referring now to FIG. 5, the lower vane end connection is the same as shown in FIGS. 2–4 except that the dies 18*a*, 19*a* are undulated as shown so that the swaged connection is formed in an undulating shape. This form of swaged connection entirely prevents any peripheral movements of the lower vane ends and improves the strength of the swaged connections.

As will be clear, the invention provides a method for connecting the lower ends of the vanes to the base ring of the rotary element of a rotary turbine ventilator which is unique, and which especially for aluminum is highly to be preferred to spot welded or riveted connections. No marks need be scribed on the base ring before connection of the lower vane ends because the vane ends are designed to be fitted one against the other around the base ring, such marks or other indication of vane location being needed in the case of either spot welded or riveted connections.

While preferred embodiments of the apparatus and methods afforded by the invention have been described and shown in the drawings, many modifications thereof may be made by a person skilled in the art without departing from the spirit of the invention, and it is intended to protect by Letters Patent all forms of the invention falling within the scope of the following claims.

I claim:

1. Rotary turbine ventilator, comprising a plurality of vertically disposed circularly spaced outwardly bowed vanes, an upper crown, a lower base ring, the upper ends of said vanes being connected equally spaced around the edge of said crown, the lower ends of said vanes being connected side by side around said base ring, bearing means supported above said crown and said crown being engaged therewith for rotation about a vertical axis, said vanes and said base ring being rotatable about said vertical axis with said crown, a cylindrical connection sleeve extending downward from within said base ring, said base ring being disposed concentrically spaced around said cylindrical connection sleeve, said lower ends of said vanes being arcuately formed and being disposed side by side in mutual engagements one with another and each against a lower edge portion of said base ring and said lower ends of said vanes and said lower edge portion of said base ring being bent inwardly and then conically divergent downwardly and the lowermost edge portion of said base ring being bent upwardly and inwardly against said downwardly divergent portions of said vane ends and firmly crimped thereagainst, whereby said vane ends are securely fixed to said base ring.

2. The combination of claim 1, wherein the upper end of each said vane is connected to said crown by a single rivet.

3. The combination of claim 1, wherein said conically downwardly divergent portions of said base ring and lower vane ends are of undulating form around the periphery of said base ring.

* * * * *